United States Patent [19]

Rodda

[11] 4,413,578

[45] Nov. 8, 1983

[54] CAMMING ARRANGEMENT FOR THREAD HANDLING DEVICE

[75] Inventor: Donald Rodda, Butler, N.J.

[73] Assignee: The Singer Company, Stamford, Conn.

[21] Appl. No.: 422,770

[22] Filed: Sep. 24, 1982

[51] Int. Cl.[3] ..... D05B 49/00

[52] U.S. Cl. ..... 112/254; 112/250

[58] Field of Search ..... 112/250, 254, 241, 302

[56] References Cited

U.S. PATENT DOCUMENTS 171,558 12/1875 Gibbs .
276,113 4/1883 Willcox et al. .
331,026 11/1885 Bigelow .
908,434 12/1908 Woodward .
3,561,385 2/1971 Johnson .
3,587,495 6/1971 Johnson .
4,263,859 4/1981 Johnson .
4,341,171 7/1982 Johnson .

*Primary Examiner*—Louis Rimrodt
*Assistant Examiner*—Andrew M. Falik
*Attorney, Agent, or Firm*—William V. Ebs; Robert E. Smith; Edward L. Bell

[57] ABSTRACT

A thread handling device including an elongate rigid member and a strip with fibers extending outwardly to contact thread in a sewing machine passing between the rigid member and strip is provided with bracketing thread controlling cams which improve the performance of said device.

7 Claims, 11 Drawing Figures

CAMMING ARRANGEMENT FOR THREAD HANDLING DEVICE

DESCRIPTION

BACKGROUND OF THE INVENTION

1. Field of the Invention

The invention is directed to a camming arrangement for a thread handling device.

2. Description of the Prior Art

U.S. Pat. No. 4,263,859 of Ralph E. Johnson for "Thread Handling System for a Sewing Machine", issued Apr. 28, 1981, discloses a thread handling system which includes a thread handling device with elongate members that serve to hold and to meter needle thread to a needle and looptaker of a lockstitch sewing machine. The system further includes a thread tensioner. Thread from a spool extends to the thread tensioner, and beyond the tensioner the thread extends to the thread handling device. Beyond the thread handling device, the thread extends to the needle. A takeup, which brackets the thread handling device, sets stitches and pulls thread through the tensioner. The takeup moves the thread in one direction in the thread handling device to a stitch position at one end of its operating range, and moves in the opposite direction free of thread to the other end of its operating range, after which thread in the device moves to a position of reengagement with the takeup to shorten the path for thread between the tensioner and needle such that a quantity of thread is thereby supplied for use by the needle and looptaker. Copending patent application Ser. No. 357,446 filed Mar. 12, 1982, of Donald Rodda (The Singer Company) for "Thread Handling Arrangement with Fiber Carrying Strip and Cam" discloses such a thread handling system including a thread handling device with a fibrous strip to engage the thread and a thread controlling cam to engage thread exiting from the device. A primary purpose of the cam is to temporarily hold and so delay the descent of thread in the device such that the half-hitching of stitches due to slack thread is prevented. However, despite the improvement achieved with the construction of said application, it has been found that thread will sometimes be drawn off the top end of the cam before needed for stitch formation, and caused to rapidly descend creating slack which on occasion will result in a half-hitched stitch.

It is a principal object of the present invention to provide a thread handling device in a sewing machine with an improved camming arrangement particularly effective to eliminate the formation of defective stitches.

It is another object of the invention to reduce abrasion by and to thread in a thread handling device of the kind disclosed in the aforementioned application.

Other objects and advantages of the invention will become apparent during a reading of the specification when in connection with the accompanying drawings.

SUMMARY OF THE INVENTION

In accordance with the invention, a thread handling device including an elongate rigid member and a strip with fibers extending outwardly to contact thread in a sewing machine passing between the rigid member and strip is provided with bracketing thread engageable cams. Such cams project outwardly from opposite sides of the device and hold the thread at an acute wrap-around angle on the rigid member at and near the upper end of said device. One cam is formed to cause thread to move downwardly thereon in advance of doing so on the other, and to use up thread whereby the formation of slack such as would tend to result in half-hitched stitches is prevented.

DESCRIPTION OF THE PREFERRED EMBODIMENT

Figure 1:
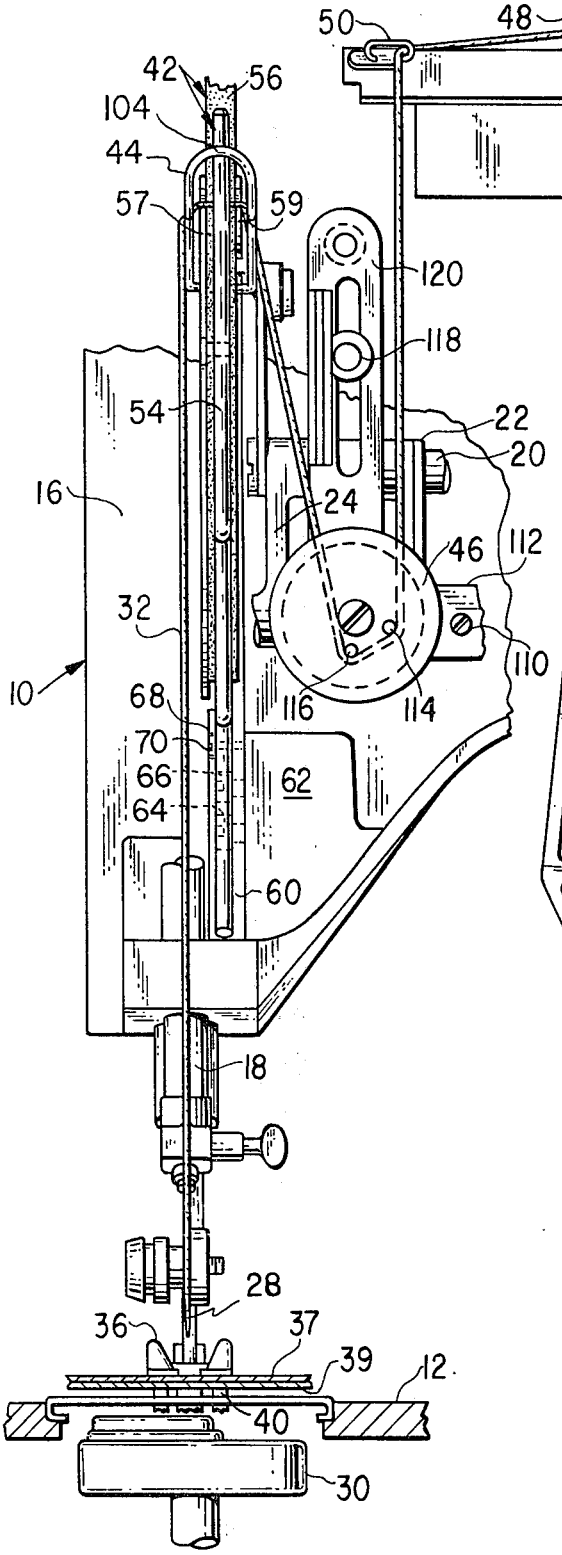
FIG. 1 is a front elevational view of a head end portion of a sewing machine with portions broken away to better show a thread handling arrangement thereon according to the invention.
Figure 2:
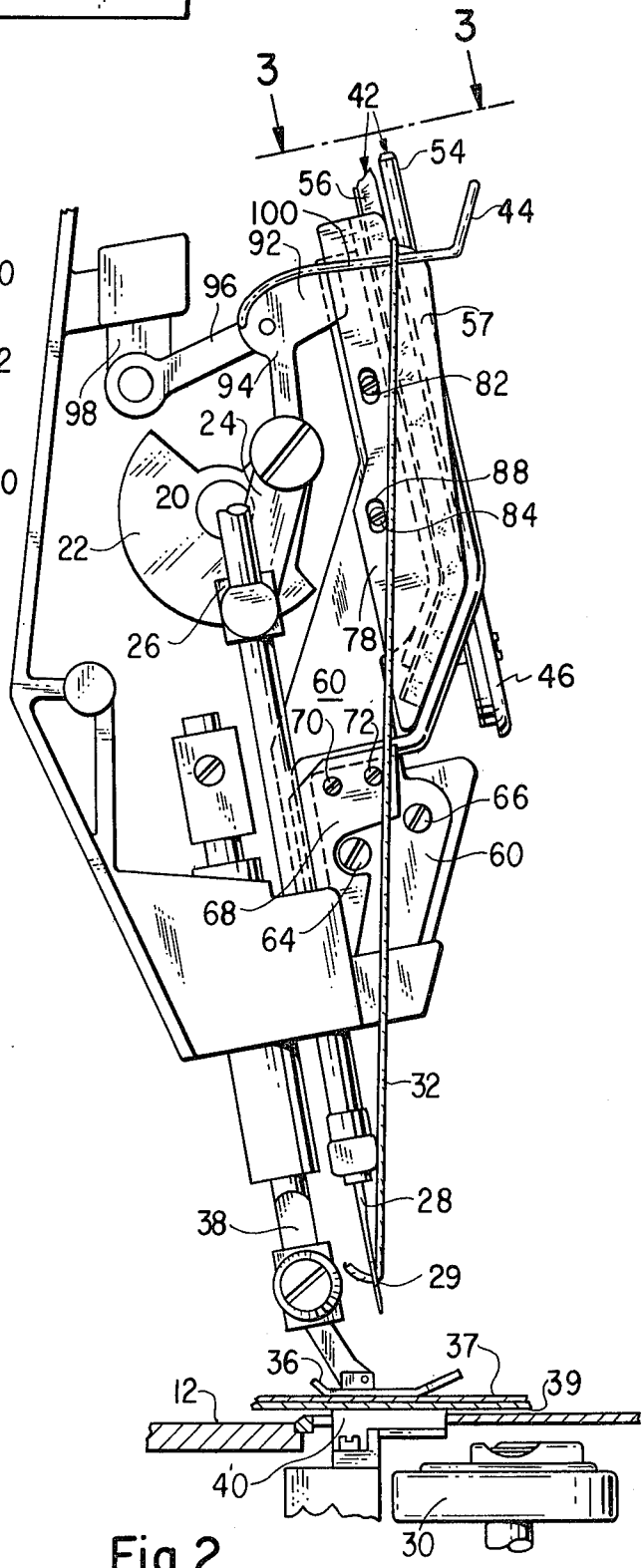
FIG. 2 is a left end elevational view of the head end portion of the machine with the cover removed.
Figure 3:
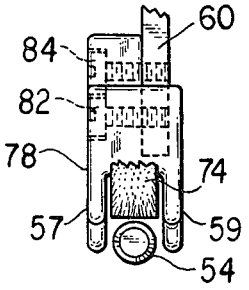
FIG. 3 is a top view of cams according to the invention taken on the plane of the line 3—3 of FIG. 2.
Figure 4:
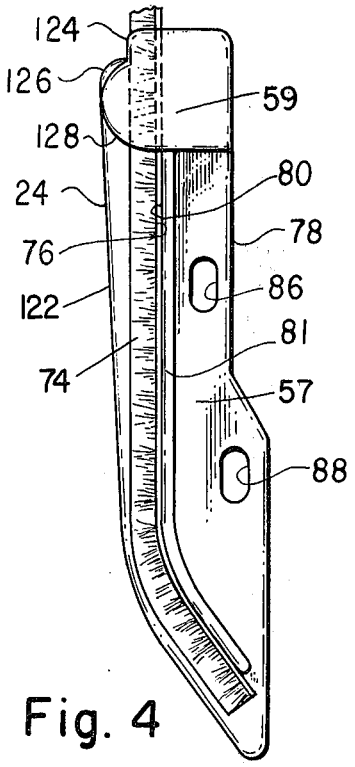
FIG. 4 is a right end view of the camming structure.
Figure 9:
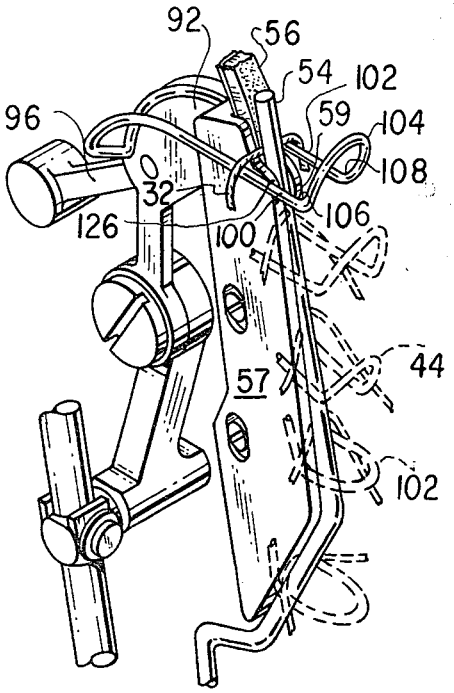
FIG. 9 is a perspective view showing the thread in various positions at the outset and throughout the descent thereof in a thread handling device and on the cams.

Referring to the drawings and in particular to FIGS. 1 and 2, reference character 10 designates a portion of a lockstitch sewing machine including a work supporting bed 12 and sewing head 16. A needle bar 18 is carried in the sewing head for endwise reciprocation by a rotating arm shaft 20 acting through a counterbalanced crank 22, a connecting drive link 24 and finally a collar 26 which is pivotally connected to the needle bar. A sewing needle 28 is carried by the lower end portion of the needle bar 18 and cooperates with a rotary looptaker 30 journalled in the bed and driven in timed relationship to the arm shaft in a well known manner for concatenating needle thread 32 to form lockstitches with bobbin thread (not shown). A detailed description of the manner in which such lockstitches are formed may be found, for example, in U.S. Pat. No. 2,862,468 of R. E. Johnson, for "Ornamental Stitch Sewing Machines" issued Dec. 2, 1958, and assigned to The Singer Company, A presser foot 36, affixed to a presser bar 38 is utilized to urge fabric 37 and 39 into contact with a feed dog 40 by means of which work is advanced under the needle 28. The feed dog is moved in timed relationship to the needle and looptaker by conventional work feeding mechanism which may be of the type shown and described, for example, in U.S. Pat. No. 3,527,183, for "Work Feeding Mechanism for Sewing Machines" of The Singer Company, issued Sept. 8, 1972.

Thread 32 is supplied to the needle 28 by a thread handling device 42 shown in association with a thread takeup member 44 and a thread tensioner 46. The thread extends from a spool (not shown) through thread guides 48 and 50 to tensioner 46. The thread passes through the thread tensioner and thence into the thread handling device 42 where it passes between elongate members 54 and 56 of the device. A pair of thread engageable cams 57 and 59 bracket the thread handling device 42, and thread takeup member 44 brackets both the thread handling device and cams, as shown. Beyond the takeup member 44, the thread extends to the needle where it is threaded through the eye 29. The thread 32 is moved upwardly in the thread handling device by the takeup 44, and is moved downwardly in the device free of the takeup. During its downward movement, the thread is engaged by the cams 57 and 59 as hereinafter described.

Elongate member 54 is affixed in the head end of the machine between: (1) a plate 60 which is secured to fixed head end frame structure 62 by screws 64 and 66; and (2) a gusset plate 68 which is tightened against member 54 by screws 70 and 72 extending into structure 62. Elongate member 56 is comprised of individual fibers 74 which extend outwardly from a backing strip 76. The backing strip is secured with a suitable adhesive to a holder 78 along a frontal surface 80 extending between the cams 57 and 59 and along a longitudinal flange 81. As shown, cams 57 and 59 are integral part of holder. The holder 78 is affixed to plate 60 with screws 82 and 84 extending through elongate holder slots 86 and 88 permitting adjustment of the holder. The fibers 74 of members 56 are preferably of a synthetic plastic material such as polypropolene, "Dacron" or "Nylon", although natural bristles may be used in their place. The backing strip 76 is preferably of a flexible plastic material although any other material suitable for holding the fibers may also be utilized. Holder 78 is affixed with the screws 82 and 84 in a position causing the fibers 74 on member 56 to bear lightly against elongate member 54 which is shown in the form of a bent cylindrical rod.

Takeup member 44 and actuating mechanism therefor correspond to like functioning mechanism shown and described in the aforementioned U.S. Pat. No. 4,263,859 of Ralph E. Johnson. The takeup member 44 is affixed to an arm 92 at one end of a link 94 which has its other end pivotally connected to crank 22. A link 96 pivotally connects at one end to the link 94 as shown, and pivotally connects at the opposite end to a fixed member 98. Rotation of the arm shaft 20 results in link 94 being driven by crank 22, and the link 94 guided in its motion by the link 96 imparts reciprocatory up-down motion to the takeup member 44 along the elongate members 54 and 56 in timed relationship to the operation of the needle 28 and looptaker 30. The takeup member 44 includes thread carrying arms 100 and 102 which extend past thread exiting and thread entering sides respectively, of the thread handling device 42, and interconnect at 104 across the front of the device. The arms 100 and 102 are angled to define thread carrying troughs 106 and 108 between diverging portions.

The thread tensioner 46 is mounted on the face of the machine by a screw 110 which engages a rigid bracket 112 of the device and extends into the sewing head 16. The thread tensioner 46 is disposed to one side of the thread handling device 42 in a position relative to the operating range of the takeup member 44 (as described in Ralph E. Johnson's U.S. Pat. No. 4,263,859). Thread 32 extending through the tensioner 46 passes around pins 114 and 116 therein and between tension applying plates. Tension applied by thread tensioner 46 may be variably controlled in accordance with the position of a knob 118 slidable along resilient member 120.

Holder 78 is preferably formed as a molded plastic structure including the cams 57 and 59 as integral parts thereof. Cams 57 and 59 are formed with smooth thread engaging edges 122 and 124, respectively. Edge 122 of cam 57 extends along the entire effective length of the thread handling device 42 of the machine, whereas cam edge 124 extends along only an upper portion of such length. The cam edges extend beyond the fibers 74 of strip 76. Cam edges 122 and 124 are formed, as shown, with arcuate segments 126 and 128 at the upper end portion of the cams, the cam segment 128 being formed with a larger radius of curvature than segment 126.

Figure 5:
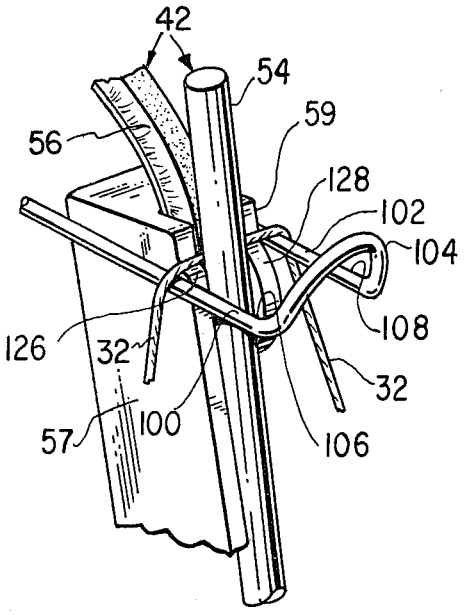
FIGS. 5, 6, 7 and 8 are enlarged perspective views showing the thread in various upper positions on the cams.
Figure 6:
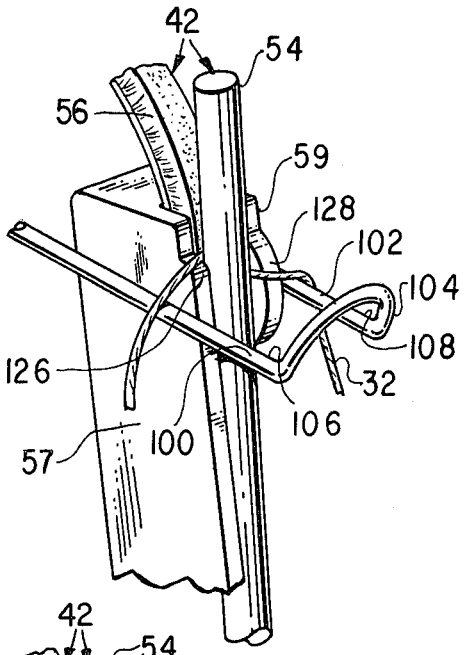
Figure 7:
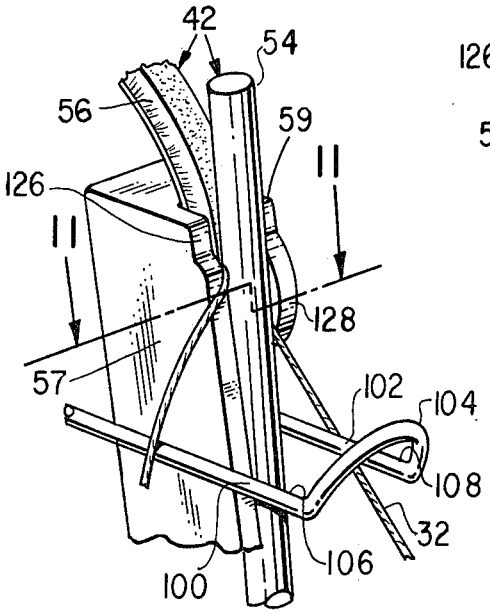
Figure 8:
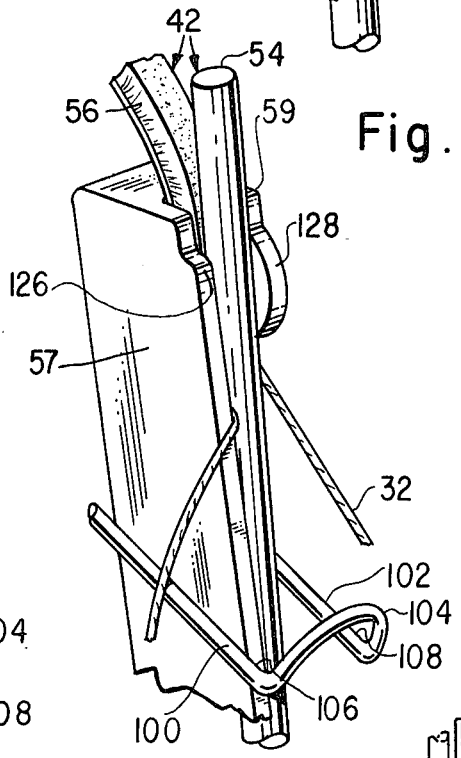
Figure 11:
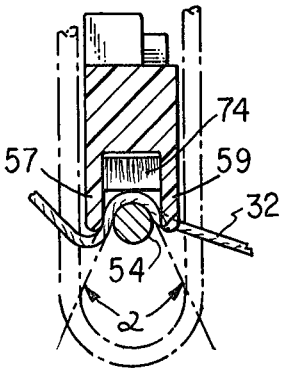
FIG. 11 is a sectional view taken on the plane of the line 11'11 of FIG. 7.

During operation of the machine, the takeup member 44 is moved up and down in timed relation to rotation of the looptaker 30 as described in the said U.S. Pat. No. 4,263,859 of Ralph E. Johnson. When the takeup member is at the top of its operating range, thread 32 is at its uppermost position in device 42 between members 54 and 56, and at its highest position on cams 57 and 59 where the thread then extends across the upper ends of arcuate segments 126 and 128 (FIG. 5). Such arcuate segments establish an angular wrap of thread at rod 54 and the edges of arcuate segments 126 and 128 (see FIG. 11) which together with the restraining effect of fibers 78 on the thread tend to prevent the thread from desending immediately when the takeup member starts to move downwardly. In the event the thread is pulled downwardly before needed by the needle and looptaker for stitch formation, as by friction in the eye of needle 28 while the needle moves toward work being sewn, thread first descends along arcuate segment 128 of cam 59 due to its large radius of curvature as compared to the radius of curvature of segment 126 (FIG. 6). The curvature and length of segment 128 are such as to cause thread to be used up as it descends along the edge of the segment, and slack such as would tend to result in half-hitched stitches is prevented. Descent along segment 128 is followed by downward movement along arcuate segment 126 on cam 57 and in device 42 (FIG. 7). The thread moves off cam 59 and descends further along cam 57 and in device 42 on fibers 74 during continued downward movement of the takeup (FIG. 8).

The angular wrap at rod 54 of thread in engagement with both of the cams 57 and 59 (characterized by an acute angle between thread portions on opposite sides of rod 54) maintains thread at the outer edge of fibers 74 as the thread moves downward in the upper portion of device 42. After the thread passes off cam 59, it is caused by cam 57 during continued downward movement in device 42 to travel across the fibers 74 only near their outer edge. With the thread moving at or near the outer edge of the fibers, tension applied by the fibers to the thread is limited and excessive abrasion of both the fibers and thread is prevented.

Figure 10:
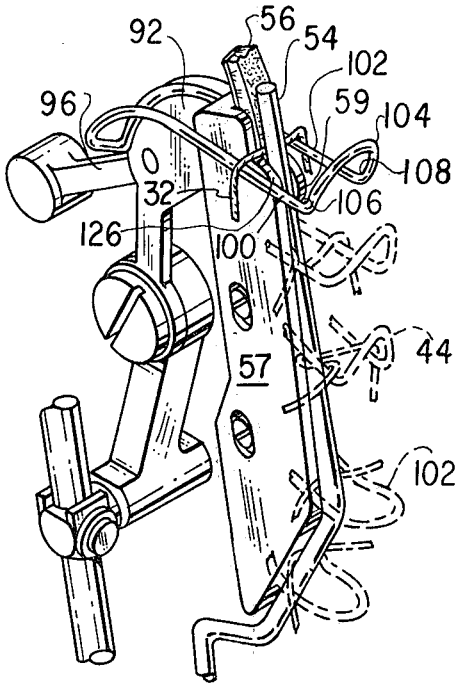
FIG. 10 is a view similar to FIG. 6 showing the thread in various positions during upward movement in the thread handling device.

The descending thread is eventually reengaged by the takeup member 44 and moved upwardly between members 54 and 56 to its uppermost position (see FIG. 10). As the takeup member moves upwardly in the device, slack thread cast off the looptaker is pulled upwardly by the takeup to provide for the formation of a stitch in the material being sewn. The slack is quickly removed by the takeup member because the fibers exert such a light frictional force on the thread, and so prevent excessive thread tension such as would otherwise result in slippage through the thread tensioner 46 and the pulling of thread from a supply spool in advance of stitch setting. Such a prompt removal of the slack is advantageous because thread is thereby removed from the vicinity of the looptaker before it can twist and prevent proper stitch formation. During the upward movement of the takeup member, the thread is pulled outwardly relative to the fibers 74 by the takeup member, and therefore only outer ends of the fibers contact the thread.

It is to be understood that the present disclosure relates to a preferred embodiment of the invention which is for purposes of illustration only and is not to be construed as a limitation of the invention. Numerous alterations and modifications of the structure herein will suggest themselves to those skilled in the art, and all such modifications and alterations which do not depart from the spirit and scope of the invention are intended to be included within the scope of the appended claims.

I claim:

1. In a sewing machine wherein a sewing needle and looptaker cooperate in the formation of lockstitches in a fabric, the combination comprising: a thread source; thread tensioning means to which thread extends from the thread source; a thread handling device into which thread extends from the tensioning device and beyond which the thread extends to the needle, the thread handling device including an elongate rigid member and a fiber supporting strip from which resilient fibers project outwardly toward said rigid member to contact the thread in the thread handling member; a takeup for setting stitches and pulling thread through the tensioning device from the supply, the takeup being movable upwardly with thread to a stitch setting position at one end of its operating range whereat the thread is disposed for temporary retention by said thread handling device, and movable downwardly free of the thread to the other end of said operating range to enable thread to move in the thread handling device away from the temporary retention position to a position of reengagement with the takeup at said other end of its operating range and during such movement shorten the path for thread between the tensioning device and needle to supply a quantity of thread for use by the needle and looptaker; and a pair of cams in the thread path which bracket the thread handling device and have edges engageable outwardly from the fibrous strip with downwardly moving thread, one of the cams being contoured to cause the thread to move downwardly thereon in advance of the other and to prevent the downwardly moving thread from becoming slack.

2. The combination of claim 1 wherein said one cam is on the thread entering side of the thread handling device.

3. The combination of claim 2 wherein said one cam is formed for engagement with thread only during an initial portion of the descent of thread in said device.

4. The combination of claim 3 wherein said other cam is formed for continued engagement with and control of the descending thread after disengagement from the said one cam.

5. The combination of claim 1 wherein the cams bracket the thread handling device and the takeup brackets the cams.

6. The combination of claim 1 wherein the cams are integral parts of a common structural member.

7. The combination of claim 1 wherein said common structural member is a molded plastic part.

* * * * *